US009936842B2

(12) United States Patent
Shoseyov et al.

(10) Patent No.: US 9,936,842 B2
(45) Date of Patent: Apr. 10, 2018

(54) DISPOSAL OF ORGANIC WASTE

(71) Applicants: Oded Shoseyov, Shoham (IL); Oded Halperin, Givatayim (IL)

(72) Inventors: Oded Shoseyov, Shoham (IL); Oded Halperin, Givatayim (IL)

(73) Assignee: Paulee Cleantec Ltd., Tel Aviv (IL)

( * ) Notice: Subject to any disclaimer, the term of this patent is extended or adjusted under 35 U.S.C. 154(b) by 10 days.

(21) Appl. No.: 14/745,716

(22) Filed: Jun. 22, 2015

(65) Prior Publication Data

US 2016/0367090 A1 Dec. 22, 2016

(51) Int. Cl.
*A47K 11/02* (2006.01)
*F23G 5/44* (2006.01)

(52) U.S. Cl.
CPC ..... *A47K 11/023* (2013.01); *F23G 5/444* (2013.01); *F23G 2200/00* (2013.01); *F23G 2205/121* (2013.01); *F23G 2207/00* (2013.01); *F23G 2900/7003* (2013.01); *F23M 2900/13003* (2013.01)

(58) Field of Classification Search
USPC ..... 4/451, DIG. 12
See application file for complete search history.

(56) References Cited

U.S. PATENT DOCUMENTS 4,346,002 A * 8/1982 Petzinger ..... A47K 11/02 210/202
4,663,045 A * 5/1987 Yeagley ..... A47K 11/02 210/612
4,832,034 A * 5/1989 Pizziconi ..... A61B 5/14528 600/364
2006/0006122 A1* 1/2006 Burns ..... C02F 1/008 210/758
2007/0131617 A1* 6/2007 Ali ..... B01J 20/28007 210/660
2008/0040846 A1* 2/2008 Cheng ..... A47K 11/02 4/449
2009/0023217 A1* 1/2009 Lacy ..... G01N 31/228 436/2
2009/0044322 A1* 2/2009 Nunez ..... A46B 11/00 4/223
2010/0259055 A1* 10/2010 Shoseyov ..... E01H 1/008 294/1.3
2010/0293741 A1* 11/2010 Ferris ..... A01K 1/01 15/339

* cited by examiner

*Primary Examiner* — Lauren Crane
(74) *Attorney, Agent, or Firm* — Dekel Patent Ltd.; David Klein

(57) ABSTRACT

Apparatus including a receptacle for holding therein organic waste, a first dispenser operative to dispense an oxidizing agent to the organic waste so as to cause an exothermic reaction that results in combustion of the organic waste, and a second dispenser operative to dispense a reducing agent that neutralizes a residual amount of the oxidizing agent that remains after the exothermic reaction.

14 Claims, 5 Drawing Sheets

DISPOSAL OF ORGANIC WASTE

CROSS-REFERENCE TO RELATED APPLICATIONS

This application is a continuation of U.S. patent application Ser. No. 13/316,586, filed Dec. 12, 2011.

FIELD OF THE INVENTION

The present invention relates generally to apparatus for dosing an oxidizing agent for cost effective disposing of pet, farm and wild animal and human organic waste and the like and more particularly to an improved apparatus and method by which organic waste and the like may be effectively treated by an oxidizing agent, to reduce its water content, by exothermic reaction, reducing bad odor, microbial contamination, parasites and infectious disease.

BACKGROUND OF THE INVENTION

Due to the increasing population of human and animals in the world, an ever increasing level of organic waste poses huge ecological, health and economic problems.

Various methods and systems have been developed to deal with these problems in the past. Sewage systems have the disadvantage of requiring expensive infrastructure. Chemical toilets have the disadvantage of requiring delivery and disposal of the chemically treated waste in a well regulated disposal site.

Incinerator toilets have also been developed which sterilize the organic waste, but typically end up with solids and liquids that require disposal in a central waste treatment system.

SUMMARY OF THE INVENTION

The present invention relates generally to apparatus for dosing an oxidizing agent for cost effective disposing of pet, farm and wild animal and human organic waste and the like and more particularly to an improved apparatus and method by which organic waste and the like may be effectively treated by an oxidizing agent, to reduce its water content, by an exothermic reaction, to reduce bad odor, microbial contamination, parasites and infectious disease.

The present invention seeks to provide improved apparatus and methods for dosing an appropriate amount of an oxidizing agent, such as potassium permanganate or any other oxidizing agent, onto or into organic waste collected in a reactor to ensure that an effective amount causes an exothermic reaction with semi-solid organic matter, resulting in water vapor. This reduces the weight of the waste matter, and reduces microbial load, infectious agents and bad odors.

The apparatus includes a reaction container, mixing device and a source of oxidizing agent such as but not limited to potassium permanganate that is added to the organic waste to initiate an exothermic reaction in which the water is evaporated, the organic matter is oxidized to give mainly carbon dioxide, nitrogen oxides which are released as volatiles and what is left is sterile odorless ash which is an order of magnetite lighter and can be used as a fertilizer or even as a source of minerals for the chemical industry.

The invention has the potential to reduce significantly the cost of organic waste operations, improve sanitation and health, reduce evolution of green house gasses such as methane that are harmful to the ozone layer, and extract useful energy from the waste.

There is thus provided in accordance with an embodiment of the present invention apparatus including a receptacle for holding therein organic waste, a first dispenser operative to dispense an oxidizing agent to the organic waste so as to cause an exothermic reaction that results in combustion of the organic waste, and a second dispenser operative to dispense a reducing agent that neutralizes a residual amount of the oxidizing agent that remains after the exothermic reaction.

In accordance with an embodiment of the present invention a sensor is provided for sensing the residual amount of the oxidizing agent, the sensor being in communication with the second dispenser so that the second dispenser dispenses the reducing agent in accordance with information from the sensor.

For example, the sensor may include a temperature sensor and the second dispenser dispenses the reducing agent in accordance with products of the exothermic reaction having reached a predetermined temperature after a predetermined time.

As another example, the sensor may include a humidity sensor and the second dispenser dispenses the reducing agent in accordance with products of the exothermic reaction having reached a predetermined humidity after a predetermined time.

As another example, the sensor may include a chemical sensor and the second dispenser dispenses the reducing agent in accordance with products of the exothermic reaction having reached a predetermined chemical composition after a predetermined time.

As another example, the sensor may include a weight sensor and the second dispenser dispenses the reducing agent in accordance with products of the exothermic reaction having reached a predetermined weight after a predetermined time.

As another example, the operator estimates (e.g., visually) the amount of the organic waste, commands the first dispenser to release an appropriate amount of the oxidizing agent with some excess, and the second dispenser dispenses the reducing agent after a predetermined time.

The reaction of the reducing agent with the oxidizing agent may cause a change in color of the oxidizing agent. The reaction of the reducing agent neutralizes the oxidizing potential of the disposed matter, thereby eliminating the risk of fire.

The receptacle may be, without limitation, a portion of a dog feces collector, a cat litter box, a bird cage, a farm animal feces collector or a trash disposal device.

BRIEF DESCRIPTION OF THE DRAWINGS

The present invention will be understood and appreciated more fully from the following detailed description, taken in conjunction with the drawings in which.

DETAILED DESCRIPTION OF EXEMPLARY EMBODIMENTS

Figure 1:
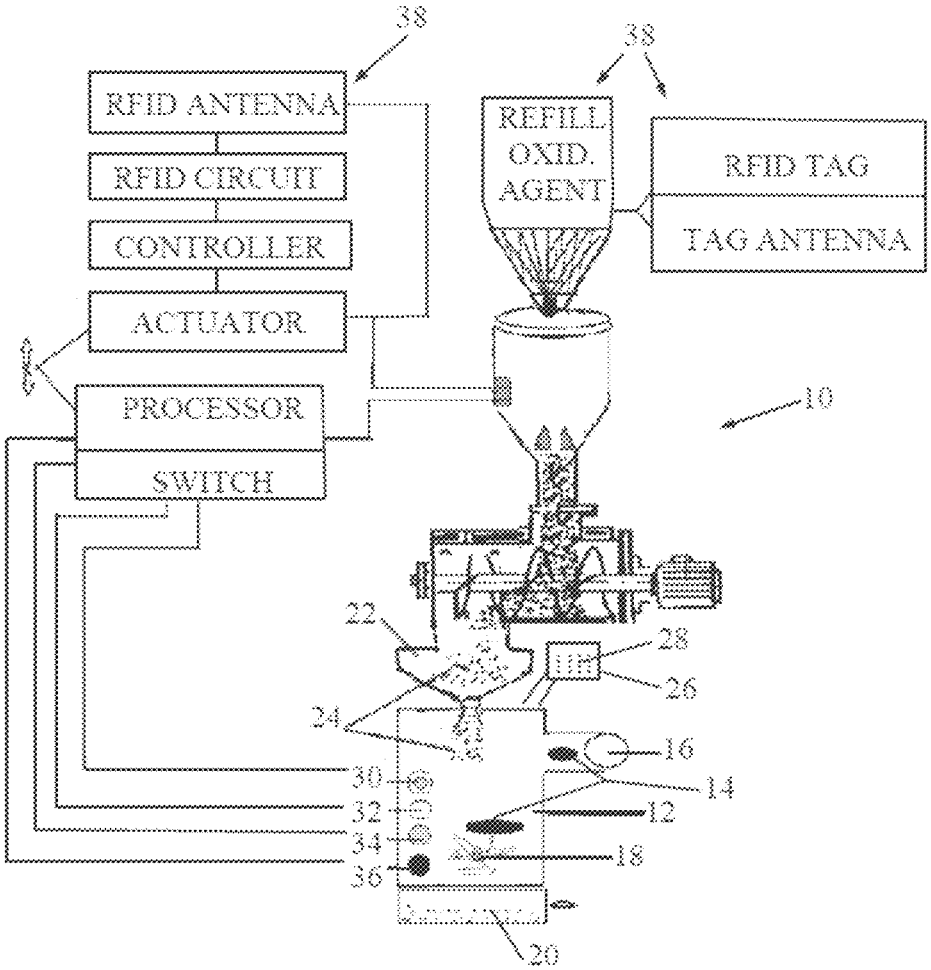
FIG. 1 is a simplified illustration of apparatus 10 for disposal of organic waste, constructed and operative in accordance with a non-limiting embodiment of the present invention.

Reference is now made to FIG. 1, which illustrates apparatus 10 for disposal of organic waste, constructed and operative in accordance with a non-limiting embodiment of the present invention.

Apparatus 10 includes a receptacle 12 for holding therein organic waste 14, such as but not limited to, excreta of a dog, cat or any other domesticated or wild animal. Receptacle 12 may have an inlet 16 for introduction therein of organic waste 14, and a blender (mixer) 18 for mixing and/or grinding (chopping, pulverizing, etc.) organic waste 14 for more efficient oxidation thereof. A collection receptacle 20 may be provided for collecting therein products of oxidation of organic waste 14.

A first dispenser 22 dispenses an oxidizing agent 24 to organic waste 14 so as to cause an exothermic reaction that causes combustion of organic waste 14, preferably into ash. Non-limiting examples of oxidizing agent 24 include a peroxide, such as hydrogen peroxide, calcium peroxide, and/or magnesium peroxide, etc.; a persulphate, such as sodium persulphate, potassium persulphate, and/or ammonium persulphate, etc; ozone; a permanganate, such as sodium permanganate, potassium permanganate, etc; chlorine dioxide; and/or a halogen, such as chlorine, bromine, iodine, and/or fluorine, etc. The oxidizing agents can be used each alone or in admixture of two or more, and may be liquid, solid, gel and the like.

A second dispenser 26 dispenses a reducing agent 28 that neutralizes a residual amount of oxidizing agent 24 that remains after the exothermic reaction. Non-limiting examples of reducing agent 28 include ascorbic acid, metal sulfites, metal hydrogensulfites, metal thiosulfates, metal metabisulfites, metal dithionites, phosphorous acid ($H_2PHO_3$) and metal salts thereof, hypophosphorous acid ($HPH_2O_2$) and metal salts thereof, and the like. The metal sulfites, the metal hydrogensulfites, the metal thiosulfates, the metal dithionites, and the metal salts of phosphorous acid and hypophosphorous acid include, for example, alkali metal salts and alkaline earth metal salts. Among them, examples include sodium sulfite ($Na_2SO_3$), sodium hydrogensulfite ($NaHSO_3$), sodium thiosulfate ($Na_2S_2O_3$), sodium dithionite ($Na_2S_2O_4$), sodium phosphite ($Na_2PHO_3$), sodium hypophosphite ($NaPH_2O_2$) and potassium metabisulfite ($K_2S_2O_5$). The reducing agents can be used each alone or in admixture of two or more, and may be liquid, solid, gel and the like.

Second dispenser 26 may dispense reducing agent 28 into receptacle 12, or alternatively may dispense reducing agent 28 onto products of the oxidation process outside of receptacle 12.

In accordance with an embodiment of the present invention a sensor is provided for sensing the residual amount of oxidizing agent 24. The sensor is in communication with second dispenser 26 so that second dispenser 26 dispenses reducing agent 28 in accordance with information from the sensor.

For example, the sensor may include a temperature sensor 30 and second dispenser 26 dispenses reducing agent 28 in accordance with products of the exothermic reaction having reached a predetermined temperature after a predetermined time. As one example, after the onset of the exothermic reaction which results in a rise in temperature, the dispenser continues to add small predetermined quantities of the oxidizer as long as the temperature does not decrease. When the temperature starts to decrease, this indicates to the system that the organic matter has been consumed and dispensing is stopped.

As another example, the sensor may include a humidity sensor 32 and second dispenser 26 dispenses reducing agent 28 in accordance with products of the exothermic reaction having reached a predetermined humidity after a predetermined time.

As another example, the sensor may include a chemical sensor 34 and second dispenser 26 dispenses reducing agent 28 in accordance with products of the exothermic reaction having reached a predetermined chemical composition after a predetermined time.

As another example, the sensor may include a weight sensor 36 and second dispenser 26 dispenses reducing agent 28 in accordance with products of the exothermic reaction having reached a predetermined weight after a predetermined time.

For example, reduction of humidity indicates the termination of water removal. Other sensors that may be installed to monitor the reaction are gas sensors that may monitor $CO_2$, CO, NO or any other volatile substance which is emitted from the reactor. Other sensors may be conductivity, resistance, colorimetric or any physical or chemical parameter that may be correlated with the exothermic reaction of oxidizing agent 24 and the organic matter. The sensor may be a transducer that determines the weight of the organic waste which sends the signal to a microprocessor which controls the dispenser. Alternatively, the sensor may determine the volume of the organic waste.

The reaction of reducing agent 28 with oxidizing agent 24 may cause a change in color of oxidizing agent 24. For example, this eliminates the oxidizing potential of the matter and prevents purple staining that is typical of potassium permanganate.

The dispensers may be controlled and actuated with RF identification system 38, including RFID tags, antennas, controllers and actuating mechanisms, for example.

Determination of the appropriate amount of reducing agent 28 for neutralizing the residual amount of oxidizing agent 24 that remains after the exothermic reaction is unpredictable without sensing with the sensor, and would otherwise require extensive experiments with different types of feces with different relative humidities.

Instead of the control loop or automatic dispensing described above, the amount of oxidizing agent 24 or reducing agent 28 released to the reaction may be done manually. A manual dosing device may be a dispenser that releases predetermined quantities suitable to perform the reaction. The dispensed amount may be estimated by the user based on manufacturer recommendations and/or previous experience. The dispenser may be of type that dispenses a constant or variable dose of powdered, granulated or capsulated material. The dispenser for oxidizing agent 24 may be as simple as pre-packed capsules or granules at a dose suitable to cause an exothermic reaction with a typical amount of organic waste. The dispenser for reducing agent 28 may be as simple as pre-packed capsules or granules at a dose suitable to neutralize the residual oxidizing agent 24.

The reactor may be mobile or stationary, disposable or permanent, part of a collecting device or a separate device. Heat generated by the exothermic reaction may be converted by thermoelectric devices to electricity. Alternatively, steam generated by the exothermic reaction may be utilized to operate an electric generator.

Example of oxidation of waste and reduction of excess oxidant:

100 gr of dog feces were mixed with four 2.5 gr portions of potassium permanganate. After about 20 seconds an exothermic reaction occurred, temperature rose to about 100° C., and a dry odorless material appeared. Two gr of potassium metabisulfite were added and mixed with the remaining solid. The resultant ash was disposed directly on a green lawn. No purple stains and no phytotoxic signs were observed in a period of 30 days.

Figure 2:
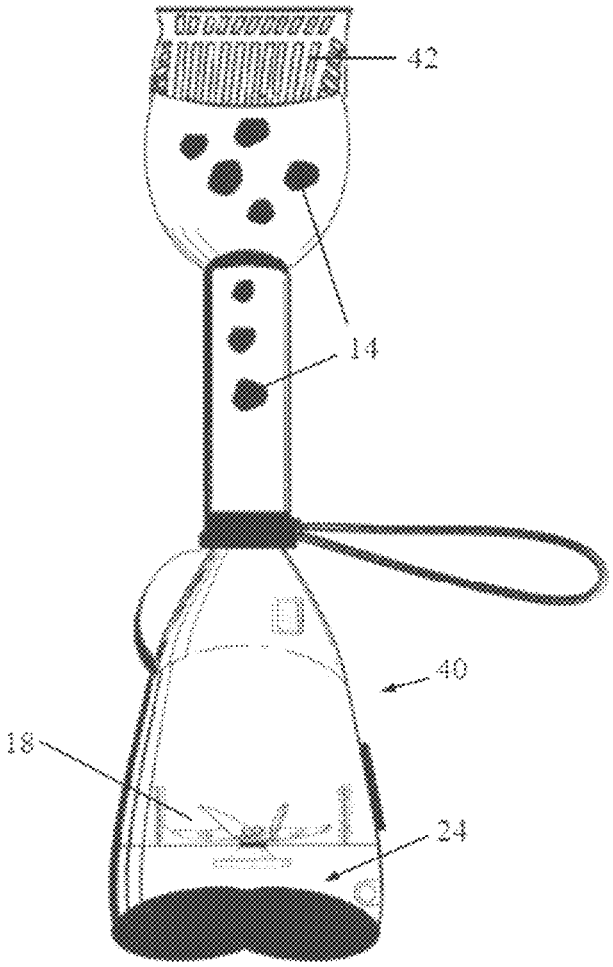
FIGS. 2-8 are simplified illustrations of receptacles used to carry out the invention, in accordance with embodiments of the invention.
Figure 3:
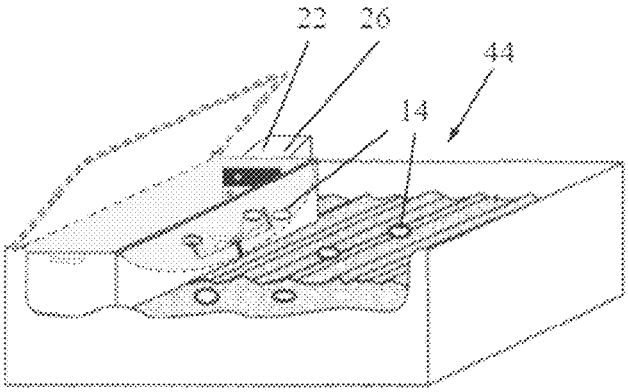
Figure 4A:
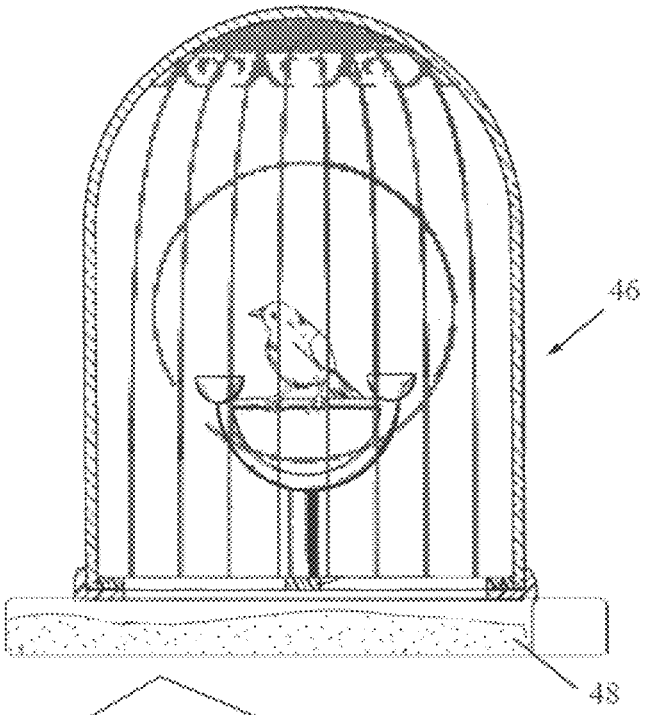
Figure 4B:
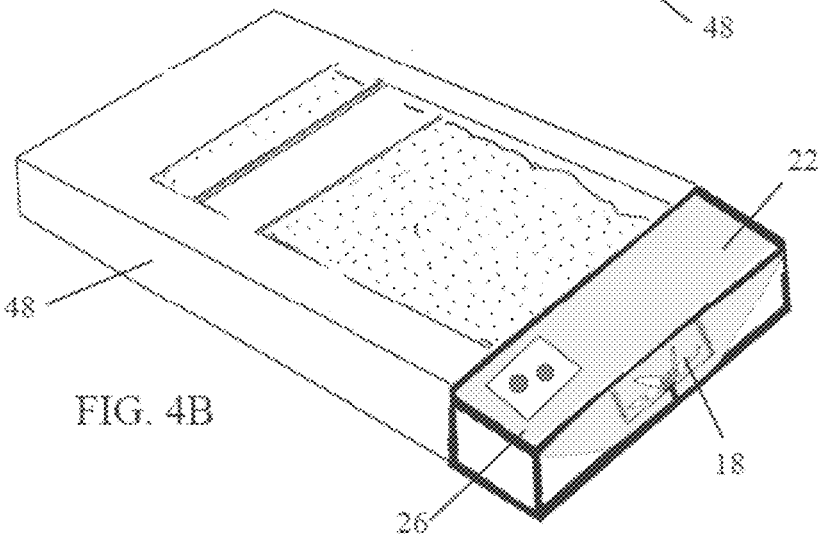

FIGS. 2-8 illustrate different, non-limiting examples of receptacles used to carry out the invention. The receptacle may be, without limitation, a portion of a dog feces collector 40, provided with a scoop 42 for collecting exudates, as seen in FIG. 2. In FIG. 3, the receptacle is a cat litter box 44, wherein the first and second dispensers 22 and 26 are provided as cartridges or may be built-in to the litter box 44. In FIGS. 4A-4B, the receptacle is a bird cage 46, wherein the first and second dispensers 22 and 26 are provided as cartridges or may be built-in to a waste tray 48 of the cage 46.

Figure 5:
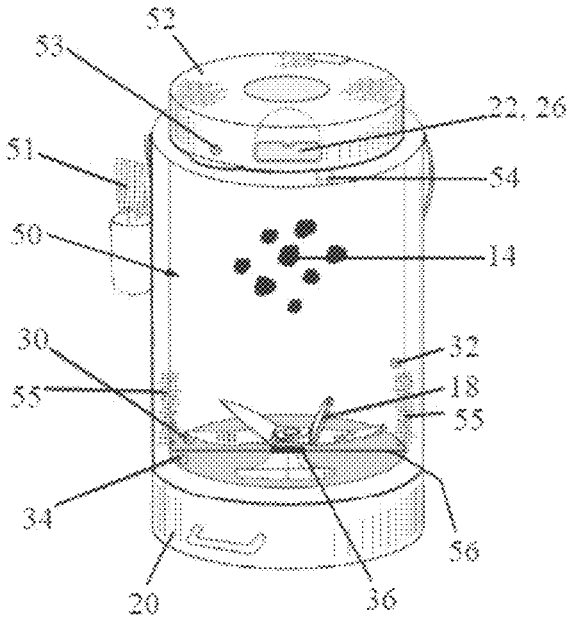

In FIG. 5, the receptacle is a farm animal feces collector 50. Collector 50 may include a scoop 51 for collecting exudates. A cover 52 may be provided with an electric eye 53 or other suitable sensor for automatic opening of the cover. The first and second dispensers 22 and 26 may be provided as cartridges for insertion into cover 52. One or more control buttons 54 may be provided for operating the device. Brushes 55 may be provided on a rotating axle 56 for cleaning sides of collector 50.

Figure 6:
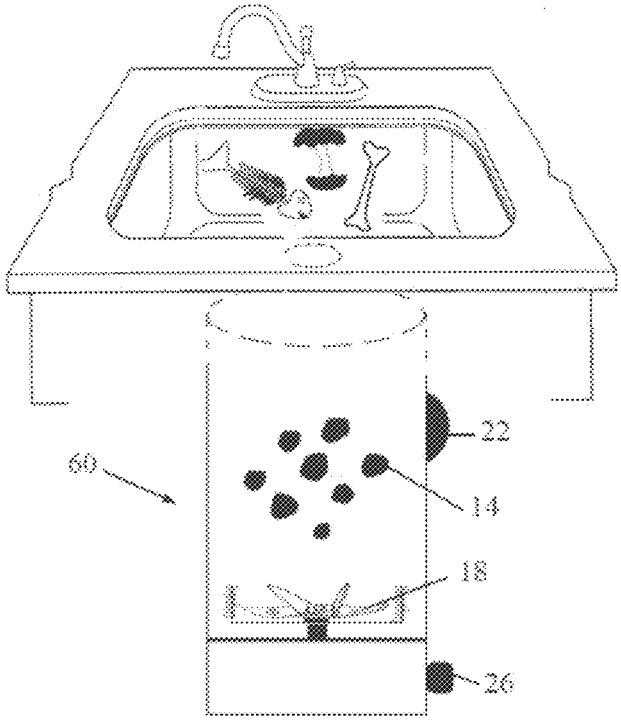

In FIG. 6, the receptacle is a trash disposal device 60, which may be installed under a kitchen sink or the like.

Figure 7:
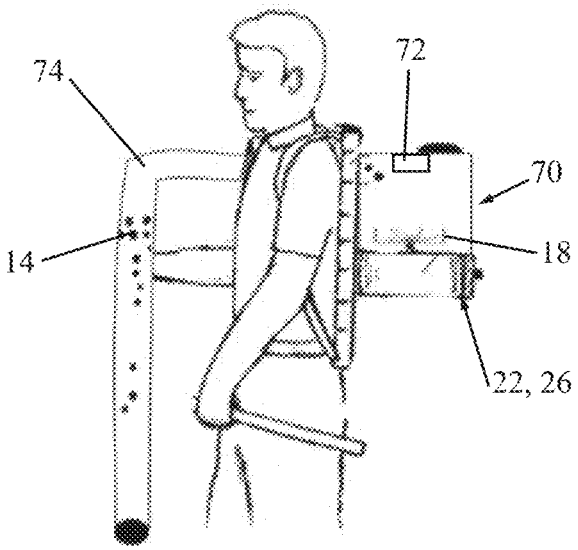
Figure 8:
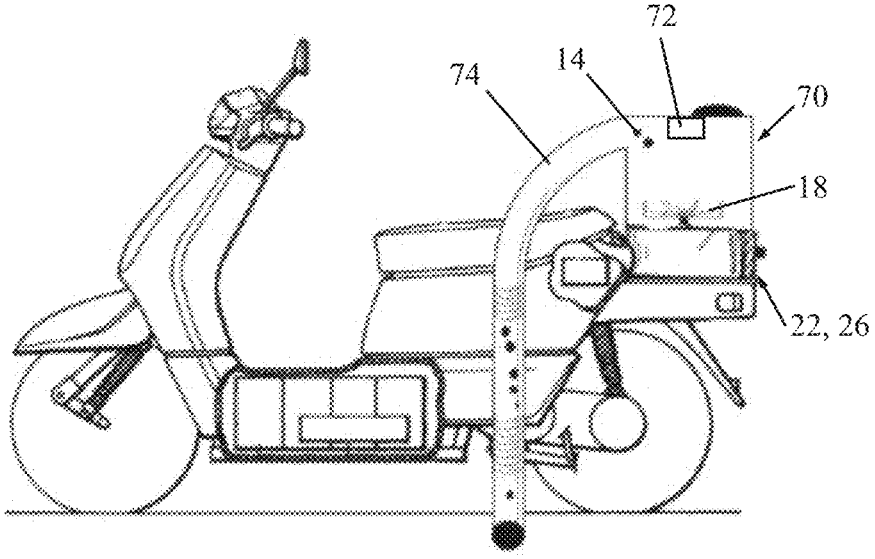

In FIGS. 7 and 8, a receptacle 70 is provided with a vacuum pump 72, which draws and collects organic waste 14 via a collection tube 74 into receptacle 70. In FIG. 7, receptacle 70 is a backpack, whereas in FIG. 8, it is mounted on a vehicle.

What is claimed is:

1. Apparatus comprising:

a receptacle for holding therein organic waste;

a first dispenser operative to dispense an oxidizing agent to said organic waste so as to cause an exothermic reaction that results in combustion of said organic waste;

a second dispenser operative to dispense a reducing agent that neutralizes a residual amount of said oxidizing agent that remains after said exothermic reaction; and brushes provided on a rotating axle for cleaning sides of said receptacle, and wherein said receptacle comprises a cover and said first and second dispensers are provided as cartridges for insertion into said cover.

2. The apparatus according to claim 1, further comprising a sensor for sensing said residual amount of said oxidizing agent, said sensor being in communication with said second dispenser so that said second dispenser dispenses said reducing agent in accordance with information from said sensor.

3. The apparatus according to claim 2, wherein said sensor comprises a temperature sensor and said second dispenser dispenses said reducing agent in accordance with products of the exothermic reaction having reached a predetermined temperature after a predetermined time.

4. The apparatus according to claim 2, wherein said sensor comprises a humidity sensor and said second dispenser dispenses said reducing agent in accordance with products of the exothermic reaction having reached a predetermined humidity after a predetermined time.

5. The apparatus according to claim 2, wherein said sensor comprises a chemical sensor and said second dispenser dispenses said reducing agent in accordance with products of the exothermic reaction having reached a predetermined chemical composition after a predetermined time.

6. The apparatus according to claim 2, wherein said sensor comprises a weight sensor and said second dispenser dispenses said reducing agent in accordance with products of the exothermic reaction having reached a predetermined weight after a predetermined time.

7. The apparatus according to claim 2, wherein said first dispenser dispenses said oxidizing agent upon a user visual observation of an amount of said organic waste, and said second dispenser dispenses said reducing agent after a predetermined time.

8. The apparatus according to claim 1, wherein reaction of said reducing agent with said oxidizing agent causes a change in color of said oxidizing agent.

9. The apparatus according to claim 1, wherein said receptacle comprises a portion of a farm animal feces collector.

10. The apparatus according to claim 1, wherein said receptacle comprises a vacuum pump, which draws and collects said organic waste via a collection tube into said receptacle.

11. The apparatus according to claim 1, wherein said receptacle comprises a scoop for collecting exudates.

12. The apparatus according to claim 1, wherein said receptacle comprises a cover and a sensor for automatic opening of said cover.

13. Apparatus comprising:

a receptacle for holding therein organic waste;

a first dispenser operative to dispense an oxidizing agent to said organic waste so as to cause an exothermic reaction that results in combustion of said organic waste;

a second dispenser operative to dispense a reducing agent that neutralizes a residual amount of said oxidizing agent that remains after said exothermic reaction; and a sensor for sensing said residual amount of said oxidizing agent, said sensor being in communication with said second dispenser so that said second dispenser dispenses said reducing agent in accordance with information from said sensor, wherein said sensor comprises a humidity sensor and said second dispenser dispenses said reducing agent in accordance with products of the exothermic reaction having reached a predetermined humidity after a predetermined time.

14. Apparatus comprising:

a receptacle for holding therein organic waste;

a first dispenser operative to dispense an oxidizing agent to said organic waste so as to cause an exothermic reaction that results in combustion of said organic waste;

a second dispenser operative to dispense a reducing agent that neutralizes a residual amount of said oxidizing agent that remains after said exothermic reaction; and a cover that covers said receptacle, wherein said first and second dispensers are provided as cartridges for insertion into said cover.

* * * * *